US010501965B1

(12) United States Patent
Chaput

(10) Patent No.: US 10,501,965 B1
(45) Date of Patent: Dec. 10, 2019

(54) ENHANCED HANDCUFF APPARATUS

(71) Applicant: Creative Law Enforcement Resources, Inc., South Pasadena, CA (US)

(72) Inventor: Ivanhoe Chaput, South Pasadena, CA (US)

(73) Assignee: Creative Law Enforcement Resources, Inc., South Pasadena, CA (US)

( * ) Notice: Subject to any disclaimer, the term of this patent is extended or adjusted under 35 U.S.C. 154(b) by 0 days.

(21) Appl. No.: 16/262,735

(22) Filed: Jan. 30, 2019

Related U.S. Application Data

(60) Provisional application No. 62/768,366, filed on Nov. 16, 2018.

(51) Int. Cl.
*E05B 75/00* (2006.01)

(52) U.S. Cl.
CPC ..... *E05B 75/00* (2013.01)

(58) Field of Classification Search
CPC ..... E05B 75/00
See application file for complete search history.

(56) References Cited

U.S. PATENT DOCUMENTS

| | | | | | |
|---|---|---|---|---|---|
| 2,344,348 | A * | 3/1944 | Forsell | E05B 75/00 | 70/17 |
| 5,463,884 | A * | 11/1995 | Woo | E05B 75/00 | 70/16 |
| 5,743,117 | A * | 4/1998 | Woo | E05B 75/00 | 70/16 |
| 6,311,529 | B1 * | 11/2001 | Kang | E05B 75/00 | 70/16 |
| 6,568,224 | B1 * | 5/2003 | Taper | E05B 75/00 | 70/16 |
| 8,776,555 | B1 * | 7/2014 | Lofgren | E05B 15/0046 | 70/16 |
| 9,551,170 | B1 * | 1/2017 | Kovac | E05B 35/008 | |
| 10,180,019 | B2 * | 1/2019 | Kovac | E05B 35/008 | |

* cited by examiner

*Primary Examiner* — Christopher J Boswell
(74) *Attorney, Agent, or Firm* — Smyrski Law Group, A P.C.

(57) ABSTRACT

A handcuff is provided, including a handcuff strand having ratchet teeth, a pair of buttons on opposing sides of the handcuff, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when both of the pair of buttons are depressed.

20 Claims, 17 Drawing Sheets

FIG. 2
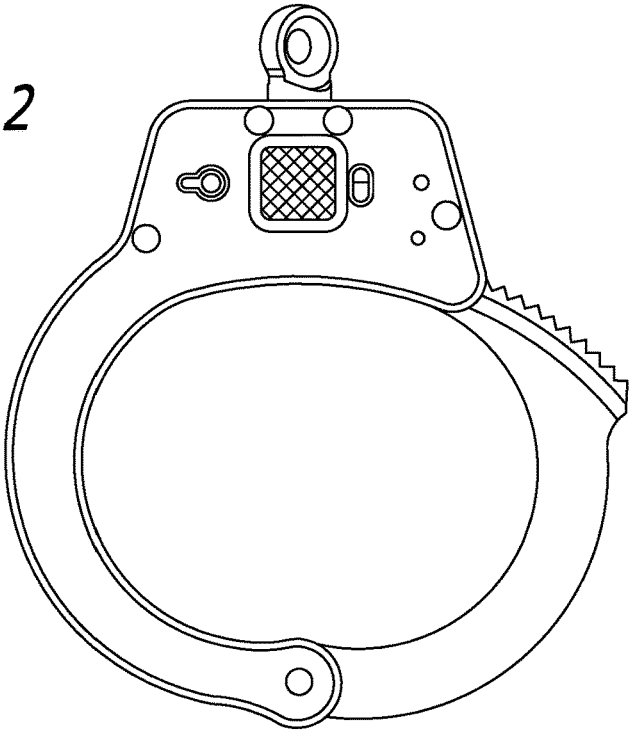
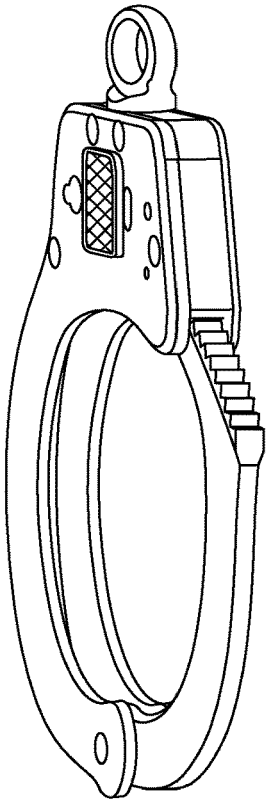
FIG. 3

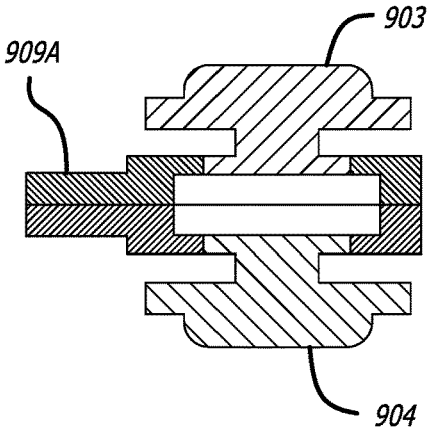
FIG. 9A
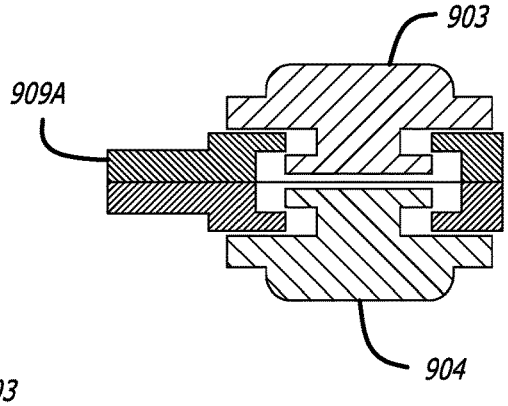
FIG. 9B
FIG. 9C
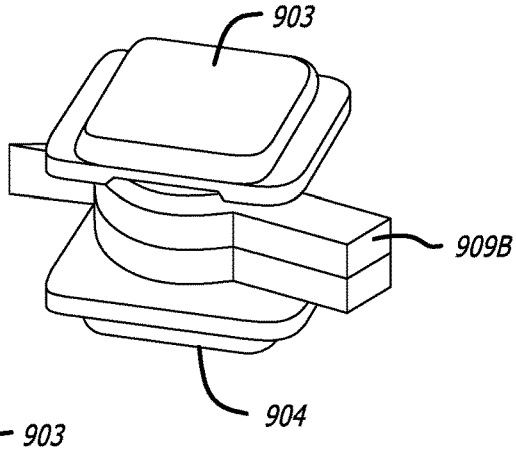
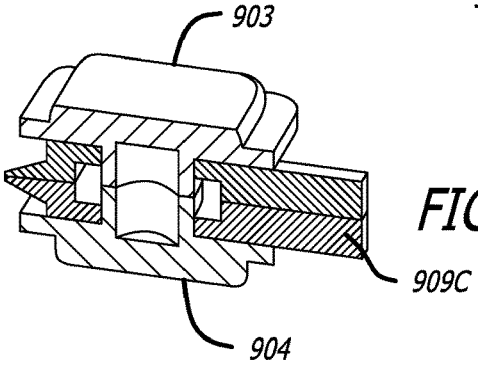
FIG. 9D
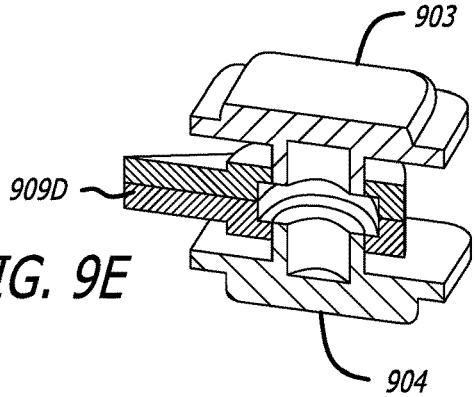
FIG. 9E FIG. 16
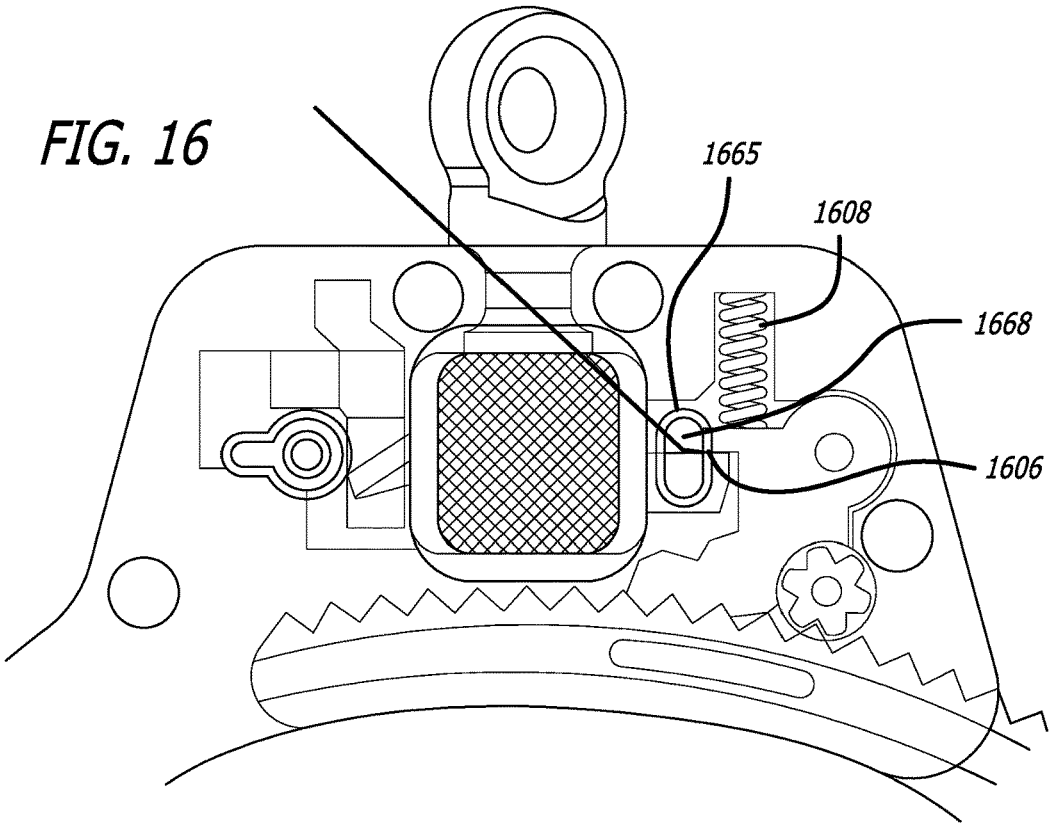
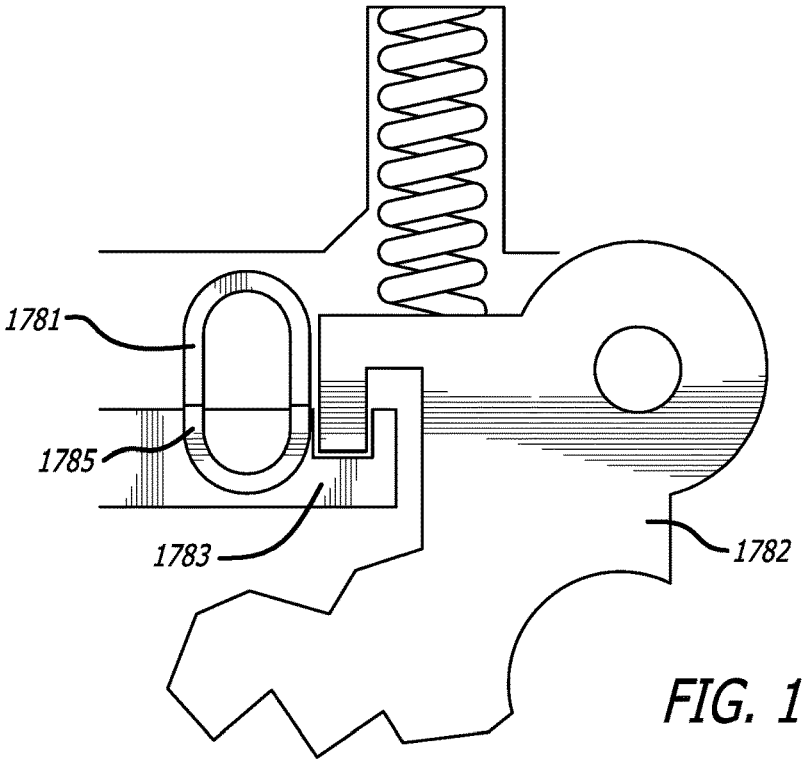
FIG. 17

ENHANCED HANDCUFF APPARATUS

The present application claims priority based on U.S. Provisional Patent Application Ser. No. 62/768,366, filed Nov. 16, 2018, inventor Ivanhoe Chaput, entitled "Enhanced Handcuff Apparatus," the entirety of which is incorporated herein by reference.

BACKGROUND

I. Field

The present design relates generally to the field of personal restraint and securing of individuals, and more specifically to handcuffs used in law enforcement, military, corrections or private security, wherein enhanced features make removing the handcuffs more difficult for the restrained individual.

II. Background

Handcuffs have been used for centuries to restrain individuals in various scenarios, including but not limited to prison or correctional facility situations. Use and construction of handcuffs and similar restraints are well known, and handcuffs are generally accepted as an effective restraint system for use by law enforcement, military personnel, security officers and various other entities worldwide. Handcuffs are a standard issued item of police equipment utilized by every major law enforcement agency in the world, and handcuffs and/or related restraints are currently in use by police officers, corrections officers, private security officers, military personnel, and so forth. The same may be said for other restraining devices, including but not limited to handcuffs, leg chains, waist chains, finger cuffs, and any manner of mechanisms used to restrain a person's wrists, hands, arms, ankles, legs, feet, or any or other body part. As used herein, all these restraining devices will be generally referred to as "handcuffs" and the teachings herein may apply to other restraining devices while illustrated for use in, for example, restraining an individual by his or her wrists.

Handcuffs have for decades employed a standard ratchet teeth type locking system wherein a standard universal handcuff key is needed to unlock them. Handcuffs are a critical piece of law enforcement equipment and very few viable alternatives to standard handcuffs exist. Although many manufacturers have attempted to create a more secure handcuff, these have largely been commercially unsuccessful and thus the same traditional handcuff style used decades ago is still typically in use today.

The standard handcuff in use by law enforcement today utilizes a bracelet type design placed around a wrist and secured via a ratchet which is then locked into place. The teeth of the ratchet engage the teeth of the spring-loaded pawl located inside the bracelet and when the pawl is forced against the ratchet, the two sets of teeth are locked together. To release the handcuffs, the pawl must be disengaged from the ratchet teeth, which is accomplished with the use of a universal handcuff key. The handcuff key is rotated to disengage the primary lock. The design of the ratchet teeth and pawl allows for free movement of a piece called a single strand when tightening the handcuffs, but prevents the single strand from loosening unless the pawl is depressed so that it may no longer engage the ratchet teeth.

Each wrist of the wearer is secured with an individual handcuff connected to another handcuff via a small chain, hinge, solid locking component, or other method. This assembly is commonly referred to as a set of handcuffs, a pair of handcuffs, "handcuffs" or any other derivative phrase indicating two or more handcuff portions secured together to form a unit capable of securing two or more appendages of a wearer.

A universal handcuff key is used to manipulate a traditional double lock bar mechanism, which moves laterally under the pawl. The double lock bar can be set to prevent the pawl from being depressed thereby locking the single strand into place. Handcuffs with double lock bars have a detent, which when engaged, stops the cuff from ratcheting tighter and prevents the wearer from over-tightening the cuffs. Tightening the handcuff ratchets could be intentional or may occur unintentionally when pressure is applied to the single strand ratchet. As a result, handcuffs may cause nerve damage or loss of circulation in a wearer's hands due to over-tightening. Additionally, some wearers may tighten the handcuffs in order to attempt an escape by utilizing lock picking tools or have an officer loosen the handcuffs where the wearer subsequently attempts to escape while the handcuffs are loosened. Double locking the handcuffs make picking handcuff locks more difficult.

These traditional and current handcuff designs can be susceptible to countermeasures and escape attempts such as lock picking. Lock picking is the practice of unlocking a lock by manipulating various components of the locking device without the use of the original key. For purposes of this document, the term "lock picking" will broadly be used to describe various countermeasures utilized in an attempt to defeat the security capabilities of handcuffs or related restraints.

Handcuffs may be opened by, for example, utilizing a handcuff key or lock pick, slipping the hands out of the handcuffs when the hands are smaller than the ratchet openings, releasing the pawl with a shim, or breaking the handcuff chain commonly known as "handcuff breaking."

A significant issue with commercial handcuffs today is the ability to unlock the cuffs using a single commonly available universal handcuff key. The universal handcuff key is simple in its design and encompasses a shaft, a bow which is used to grip the key, a single bit or tooth which engages the pawl of the handcuffs to release the single strand and a peg used to engage the double locking mechanism. Due to the simple design of the key and corresponding locking mechanism inside the common handcuff, significant vulnerabilities exist in the design.

Many law enforcement officers utilize handcuffs designed for use with a universal handcuff key due to needs for operational and field expediency. Handcuffs are often placed on suspects and physical custody of the individual(s) is transferred to other law enforcement personnel. The need to have a common key is important to ensure efficiency when cuffing, uncuffing or transporting a prisoner whether it is in a patrol environment, the courts, a jail system, prisons or any other setting. Further, emergency situations can sometimes arise when releasing the individual is required for the individual's safety, and an unusual or remote key could potentially result in harm to the individual.

Due to this commonality of the universal handcuff key design, suspects and other non-law enforcement related personnel sometimes carry handcuff keys on their person in anticipation of defeating handcuff locking mechanisms. Variations of the universal handcuff key are often hidden and kept by criminals and inmates on their person with the intent to escape and/or assault someone. Handcuff keys have been known to be built into devices and/or attached to designs to be worn on a person's clothing or body wherein they are not readily recognized as a handcuff key. These surreptitious handcuff keys can then be quickly deployed and utilized to escape or attack an officer or other individual nearby.

Additionally, a simple pin or piece of metal (or similar object) can be utilized to pick the primary handcuff locking mechanism, or a shim can be forced between the single strand ratchet teeth and the pawl, thereby releasing the handcuffs. Books and instructional videos are readily available demonstrating various ways to open handcuffs—even by the wearer. These methods for picking standard handcuffs can be learned and completed with the use of a single hand by individuals even while handcuffed with their hands behind their backs.

Lock breaking refers to a method whereby the handcuffs are twisted in such a manner as to cause undue torsion on the small chain connecting the two handcuff assemblies. Additional tension is then exerted with force by the wearer so that the chain breaks thereby freeing a suspect's hands. Such a vulnerability is also undesirable.

Certain designs have improved on prior versions of traditional handcuffs, inhibiting the ability for the wearer to defeat the locking mechanism. One such improved design includes the variations presented in U.S. Pat. No. 9,551,170, inventor Kresimir Kovac, issued Jan. 24, 2017, assigned to the assignee of the present application. However, traditional and even more modern handcuff solutions can have issues. It has been observed that in certain instances wearers of handcuffs can strike a cuff against a hard surface, in some cases repeatedly, and defeat a single or double lockbar arrangement. Additionally, on occasion ratchet teeth provided on handcuffs can wear out or wear down such that the cuffs can be rendered inoperable or unusable.

There is a need for enhanced security handcuffs which provide greater security and an inability for them to be opened by the wearer. Security handcuffs should be simple to operate, should preferably have a generally similar form factor as current designs, and still utilize a universal handcuff key. Handcuffs should be extremely difficult, if not impossible, to open by the wearer of the handcuffs even if they are in possession of the handcuff key or other lock picking device. Handcuffs should nevertheless be capable of easily being unlocked by an officer, utilizing a universal handcuff key, while at the same time avoiding the design limitations and vulnerabilities associated with earlier designs.

SUMMARY

According to a first embodiment of the present design, there is provided a handcuff comprising a handcuff single strand comprising ratchet teeth, a pair of buttons on opposing sides of the handcuff, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when both of the pair of buttons are depressed.

According to a second embodiment, there is provided a handcuff comprising a handcuff strand comprising ratchet teeth, a pair of buttons, each button of the pair of buttons positioned within a respective opposite facing exterior strand of the handcuff, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when both of the pair of buttons are depressed.

According to a third embodiment of the present design, there is provided a handcuff comprising a handcuff strand comprising ratchet teeth, a first button positioned within a first double strand element, the first button positioned proximate to and opposite a second button positioned within a second double strand element, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when the first button and the second button are depressed.

Various aspects and features of the disclosure are described in further detail below.

BRIEF DESCRIPTION OF THE DRAWINGS

FIG. 2 illustrates an assembled version of one cuff in a front view;

FIG. 3 shows a perspective view of one embodiment of the cuff according to the present design;

FIGS. 9A, 9B, 9C, 9D, and 9E illustrate various representations of the operation and cross sections of the top button, back button, and rocker arrangement;

FIG. 16 is an alternate potential risk;

FIG. 17 illustrates a first view of a first alternate design that addresses risks presented in FIGS. 15 and 16;

DETAILED DESCRIPTION

Figure 1:
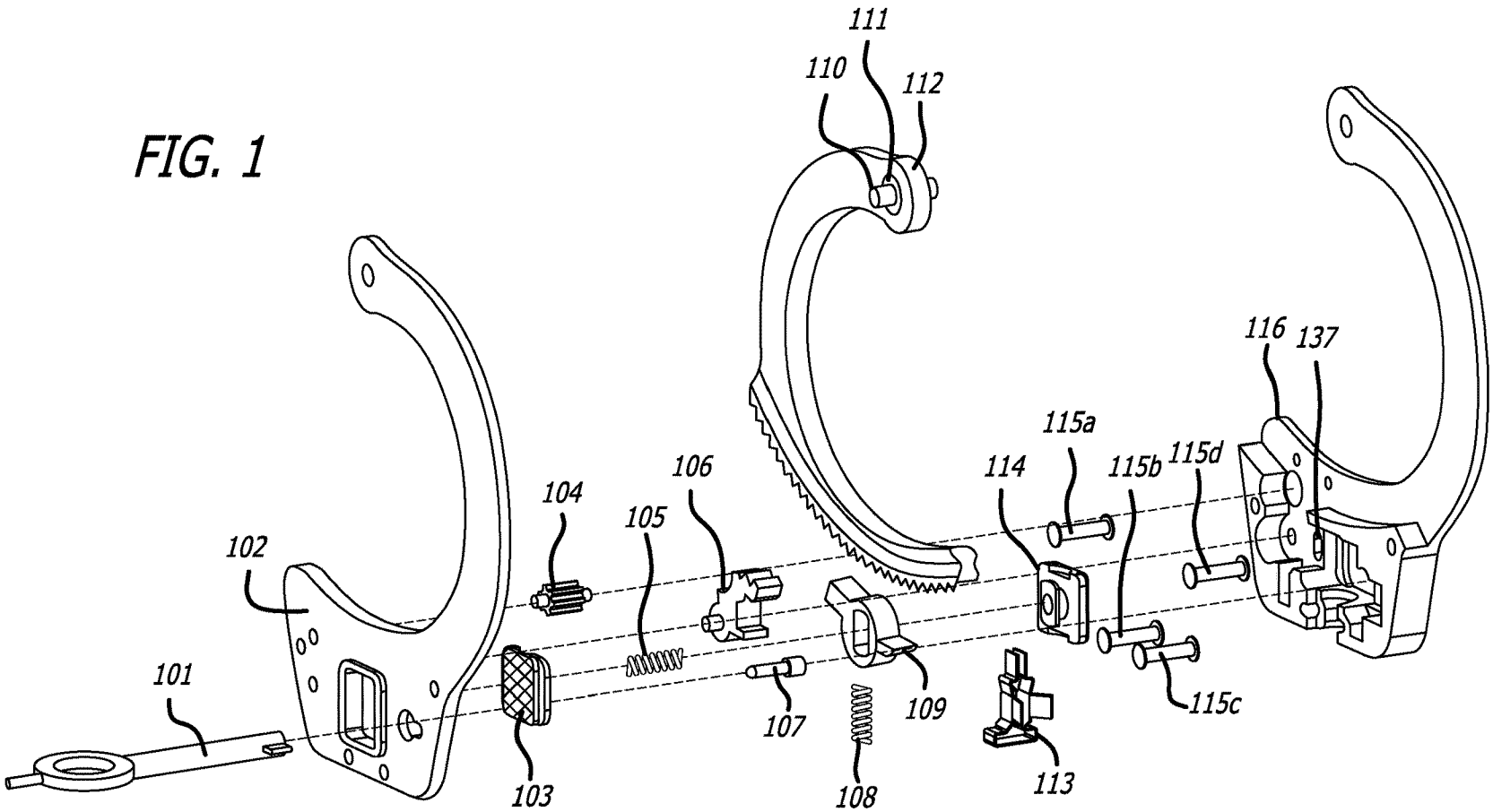
FIG. 1 shows an exploded view of one cuff according to the present design.

The present design is related to enhanced security handcuffs requiring more than a single handed manipulation to open the handcuffs while using a standard handcuff key. In certain instances two or even three hands are required to open the cuffs, typically including one hand that turns a standard handcuff key and at least one other hand that releases mechanical components on the handcuffs. Multiple and simultaneous processes may be necessary to unlock the handcuffs according to the current design.

Millions of people are arrested or detained by law enforcement agencies and related entities each year and are subsequently handcuffed in order to restrain their limbs to prevent escape and/or attack. The use of handcuffs is accepted as an effective restraint system and they are used by every major law enforcement agency in the world. The standard handcuff ratcheting design utilizing a universal handcuff key has been virtually unchanged for more than 100 years and is still in use around the world today. Handcuffs are a critical piece of law enforcement equipment and very few effective alternatives to standard handcuffs exist. Most law enforcement agencies purchase and utilize handcuffs which are similar in design and capability regardless of the manufacturer.

Law enforcement officers are typically trained in one-handed techniques to place handcuffs on a suspect's wrists and a two-handed operation to uncuff a suspect. A standard key is used for almost all handcuffs and is universal in that the same key can be used to open almost all sets of handcuffs regardless of manufacturer. Because handcuff keys are universal and millions exist, they are readily accessible to suspects and inmates restrained by handcuffs, creating a tremendous liability to law enforcement officers. This condition is exemplified in the event those under arrest or being detained are able to obtain or conceal a handcuff key and uncuff themselves. This danger extends to members of the public, and in some cases, prison inmates. A simple design enhancement can make standard handcuffs substantially more effective in their capability to restrain a wearer even if the wearer is in possession of a handcuff key, and such an improvement is the subject of the present design.

The enhanced security handcuffs according to the present design address a need for a more secure, "unpickable" handcuff. Over the years, manufacturers have attempted to improve upon the traditional handcuff design, typically seeking to create a more advanced key and corresponding locking mechanism. This route, however, has been largely unsuccessful.

Although many of the variations herein discuss the use of a standard universal handcuff key, it should be noted the designs incorporated herein also apply to handcuffs and restraints employing specialized, propriety and high security keys and locking mechanisms. Such specialized locking mechanisms may also be utilized to employ the designs described herein.

The present design allows for handcuffs to be applied to a suspect with the use of only one hand; however, one aspect of the present design requires simultaneously employing two hands with opposable digits to unlock and/or open the handcuffs, often while additionally manipulating a handcuff key. This requirement makes it extremely unlikely for an individual who is wearing the handcuffs to unlock and/or open them. This is largely because the wearer of the handcuff has one hand locked in a position where it cannot be used to manipulate that handcuff in any way. As a result, this design, requiring that two free hands act separately and simultaneously to unlock the handcuffs, makes it extremely unlikely an individual will be able to unlock the handcuffs even if he or she is in possession of a handcuff key, shim, or other lock picking device, or employs force or strikes the handcuffs against a hard surface in an attempt to open the handcuffs.

As used herein, various terms are employed and are intended to be used in the broadest sense possible. For example, the present application uses the term "officer" or "law enforcement officer" or otherwise to indicate the individual employing the handcuffs or similar restraints, and as such the term is meant to broadly encompass any individual who may have use for such a device or system, including but not limited to police officers, military personnel, corrections officers, security personnel, or other interested individuals.

The design of the handcuffs may differ from the exact configuration(s) described herein.

With respect to restraints, the term "handcuffs" is intended broadly to mean any type of handcuffs, thumb cuffs, waist chains, leg irons and/or any other type of restraint designed to restrain a person's body part(s) to include but not limited to his or her hands, wrists, fingers, arms, legs, ankles, feet, waist, shoulders, neck or any other body part. These are collectively referred to henceforth as "handcuffs".

Further, certain designs and capabilities are described herein as being a single variation or capability while others are described as having multiple capabilities. It is understood that the invention is not limited solely to the configurations described but single or multiple configurations may be employed in a single restraint or handcuff respectively, as long as the functionality described is fully or in part incorporated. The foregoing and other concepts disclosed herein are intended to be interpreted broadly and not limit the scope of the present invention.

As used herein, the term "wearer" is synonymous with the term "suspect" or "individual" or any other similar term to convey someone to whom the handcuffs have been applied or a person whom the device is intended to restrain.

In the past, handcuff manufacturers have created handcuffs with different designs to enhance security. The predominant method has been to redesign the locking mechanism to use a more complicated and/or different key. Invariably, each system has been unsuccessful without significant acceptance or use. The requirement to utilize a "standard" universal handcuff key is critical from an operational effectiveness perspective. The use of a universal handcuff key enables peace officers, security officers and correctional officers to unlock handcuffs without having to identify which keys belong to which handcuff. Additionally, officers are thereby only required to carry one handcuff key, as opposed to multiple keys belonging to various disparate restraint systems.

The design described below utilizes a traditional handcuff key, which is universally available and standardized. In certain instances, if desired, the handcuffs of the present design may employ specialized and proprietary key and locking systems to increase their effectiveness. Such handcuffs may also incorporate multiple design features discussed herein.

All drawings, schematics or other visual depictions in these designs encompass a set of handcuffs working in unison to secure one or more appendages of a wearer. In some drawings, only a single unconnected handcuff is depicted. A second handcuff is not depicted in some drawings for clarity and simplicity reasons. Actual designs will normally encompass at least two separate handcuffs connected via one or more of several available methods such as a metal chain, links, roller chain, clasps, hinges, solid bar or any other method. At least one, or in many cases, both of the individual cuffs employ the designs depicted herein.

FIG. 1 shows an exploded view of one cuff according to the present design. From FIG. 1, key 101 is inserted in the device, in particular through top double strand 102. A top button 103, pushable by a person, resides in top double strand 102. Anti-shim star wheel 104 rotates as discussed further below. Button spring 105 provides force against button 103 and button 114, while the unique binding pawl 106 is also positioned in association with top double strand 102 and rotates. Key guide 107 is provided to fit with key 101, and binding pawl 108 and rocker or rocker element 109 are shown. Single strand 112 has clasp pivot rivet 110 and clasp pivot bushing 111 affixed therein. Unique key action spring 113 provides key initiated release. Bottom button 114 is positioned on the opposite side of top button 103 and engages button spring 105 through rocker 109. Four double strand rivets 115*a*, 115*b*, 115*c*, and 115*d* offer support between top double strand 101 and bottom double strand 116. Also shown in FIG. 1 is double lock hole 137, a hole provided in bottom double strand 116 where a corresponding double lock hole is also provided on top double strand 102.

FIG. 2 illustrates an assembled version of one cuff, in a front view, while FIG. 3 shows a perspective view of the cuff. All parts are typically formed of metal, but other materials may be used, including but not limited to polymers and very hard plastics.

Figure 4:
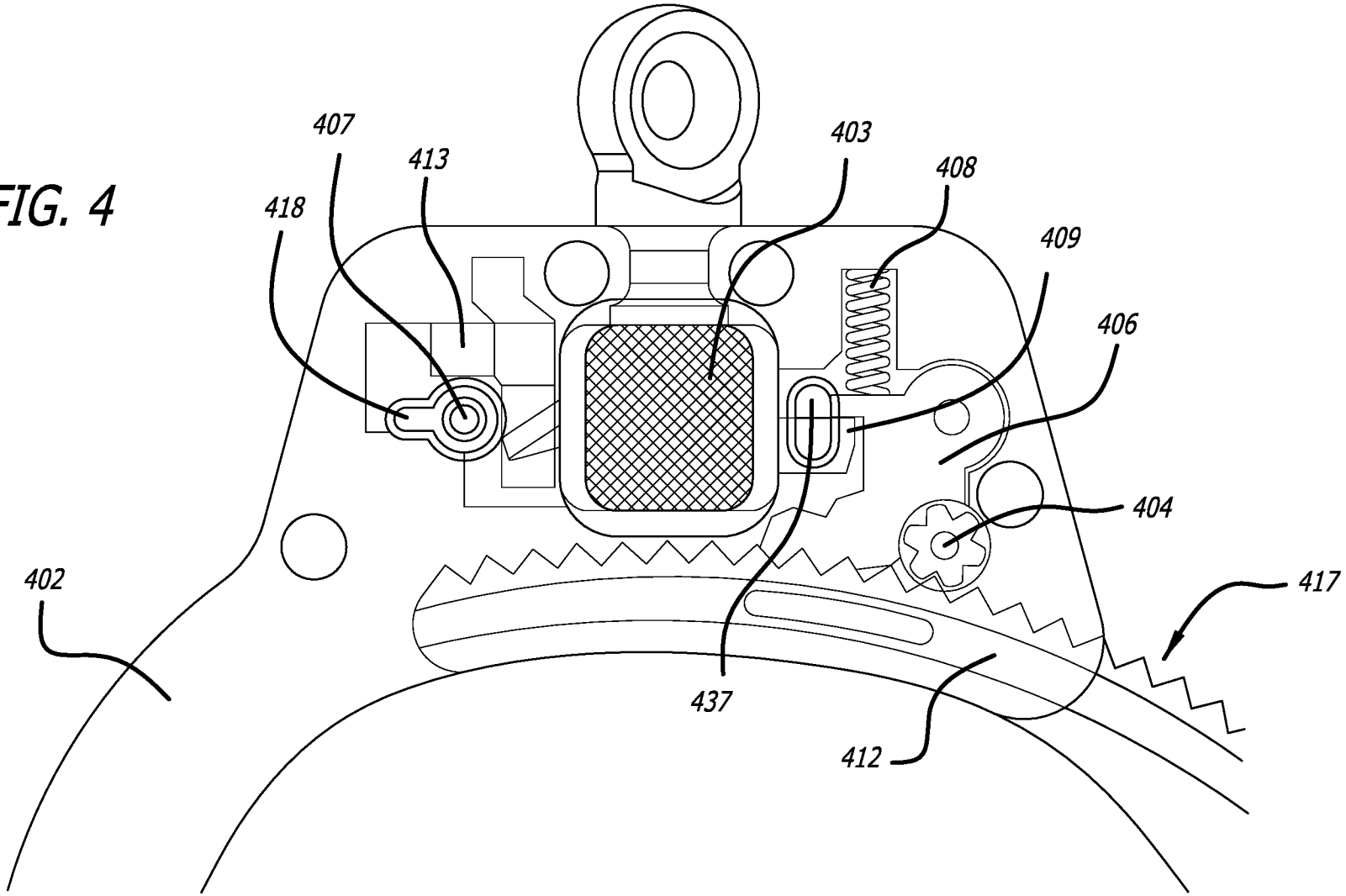
FIG. 4 is a representation of the cuff illustrating operation of the device.

FIG. 4 shows a representation of the cuff that facilitates an understanding of the operation of the device, with the representation of FIG. 4 being in the closed and locked position. In the following description of FIG. 4, element numbers generally correspond with element numbers from FIG. 1, such as anti-shim star wheel 404 of FIG. 4 corresponds to anti-shim star wheel 104 of FIG. 1. Elements not shown or seen in FIG. 4 are omitted and certain extra elements are called out. Top double strand 402 is positioned with single strand 412 locked, with teeth 417 engaging binding pawl 406. Top button 403 is shown and rocker 409 is shown behind top button 403 in this view, as is keyhole 418 and key guide 407. Binding pawl spring 408 keeps binding pawl 406 in the position shown, engaging teeth 417. In the arrangement shown, due to the binding pawl spring 408 applying force to binding pawl 406, the single strand 412 is free to rotate in only one direction, namely to tighten. Applying the cuff to a person can be very quick, known sometimes as "speedcuffing" the individual, allowing for a light spring force and smooth action when the single strand 412 is closed and engages the elements shown, including binding pawl 406. The biding pawl 406 binds upon any attempt to loosen the single strand 412. Key action spring 413 spreads when the key (not shown in this view) is inserted in keyhole 418, is rotated. The key spreads the key action spring 413, allowing the key to rotation to engage the end of the rocker 409. Also shown in FIG. 4 is double lock hole 437.

Figure 5:
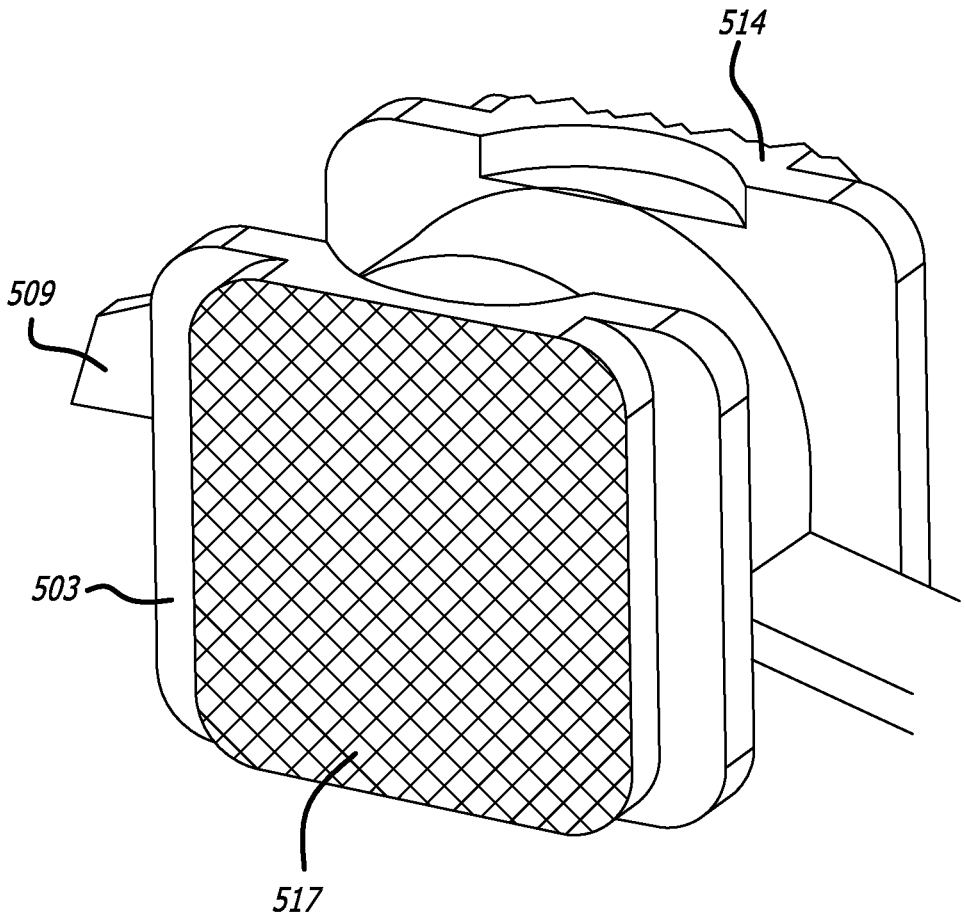
FIG. 5 illustrates the rocker arm and button arrangement according to the present design.

The rocker arm and button arrangement is illustrated in FIG. 5. From FIG. 5, top button 503 includes a patterned front surface 517 that in this embodiment serves to enable easy pressing or depression. A similar surface is provided on bottom button 514. Rocker 509 is positioned between top button 503 and bottom button 514. Button spring 105, not shown in this view, is positioned between top button 503 and bottom button 514 and passes through the hole or opening formed in rocker 509. Button spring 105 provides force against top button 503 and bottom button 514. The rocker 509, and more specifically the rocker arm, representing an arm extending outward, actuates binding pawl 106 via key rotation, rocker 509 rotation, levers provided. While the top button 503 and bottom button 514 are not depressed, the internal shape of the button constrains movement of the rocker arm to two positions, namely an unlocked position, with a single strand free to rotate in one direction, and a double lock position with the single strand fixed. Note in FIG. 1 the element provided on the back of bottom button 514 matches with rocker 109 and allows for the movement discussed. Only when both buttons, top button 503 and bottom button 514, are pressed can the rocker arm 509/109 rotate freely, allowing the key to release the binding pawl 106 and unlock the handcuffs.

Figure 6:
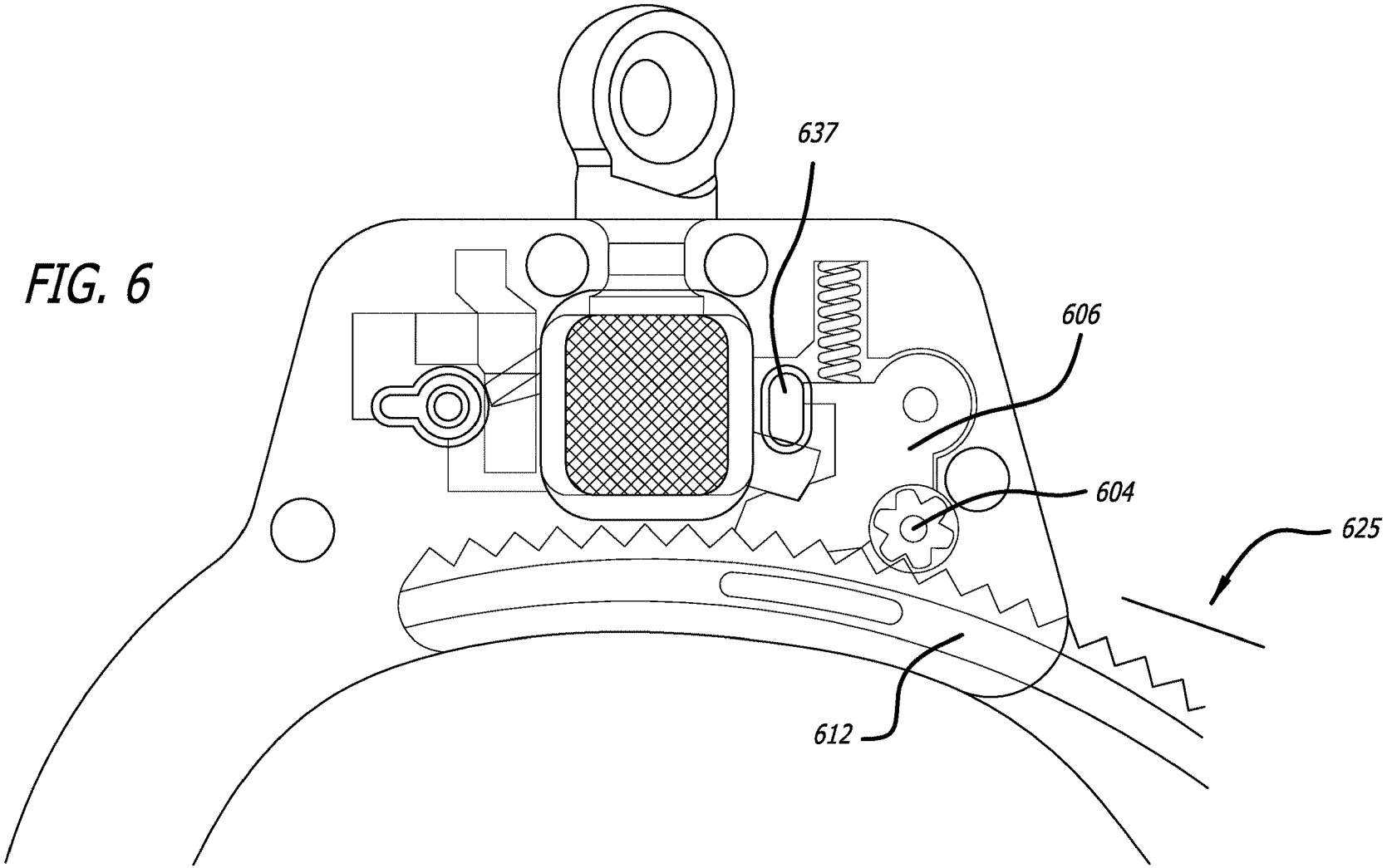
FIG. 6 illustrates the optional anti-shim star wheel and its operation.

FIG. 6 illustrates the anti-shim star wheel and its operation. From FIG. 6, the anti-shim star wheel 604 is located proximate with single strand 612 such that the various teeth or nubs or protrusions of star wheel 604 interact with teeth on single strand 612. An individual inserting a shim 625 into the side of the cuff, hoping to dislodge or rotate inner components such as binding pawl 606, is thwarted by the presence of star wheel 604 which blocks the shim but allows movement of the teeth of single strand 612. Thus this star wheel, configured to rotate, serves to prevent a shim from separating or disengaging the binding pawl and single strand. The star wheel 604 spins freely and blocks the shim or diverts the shim into the teeth of the single strand 612. Double lock hole 637 is also shown in this view.

Figure 7:
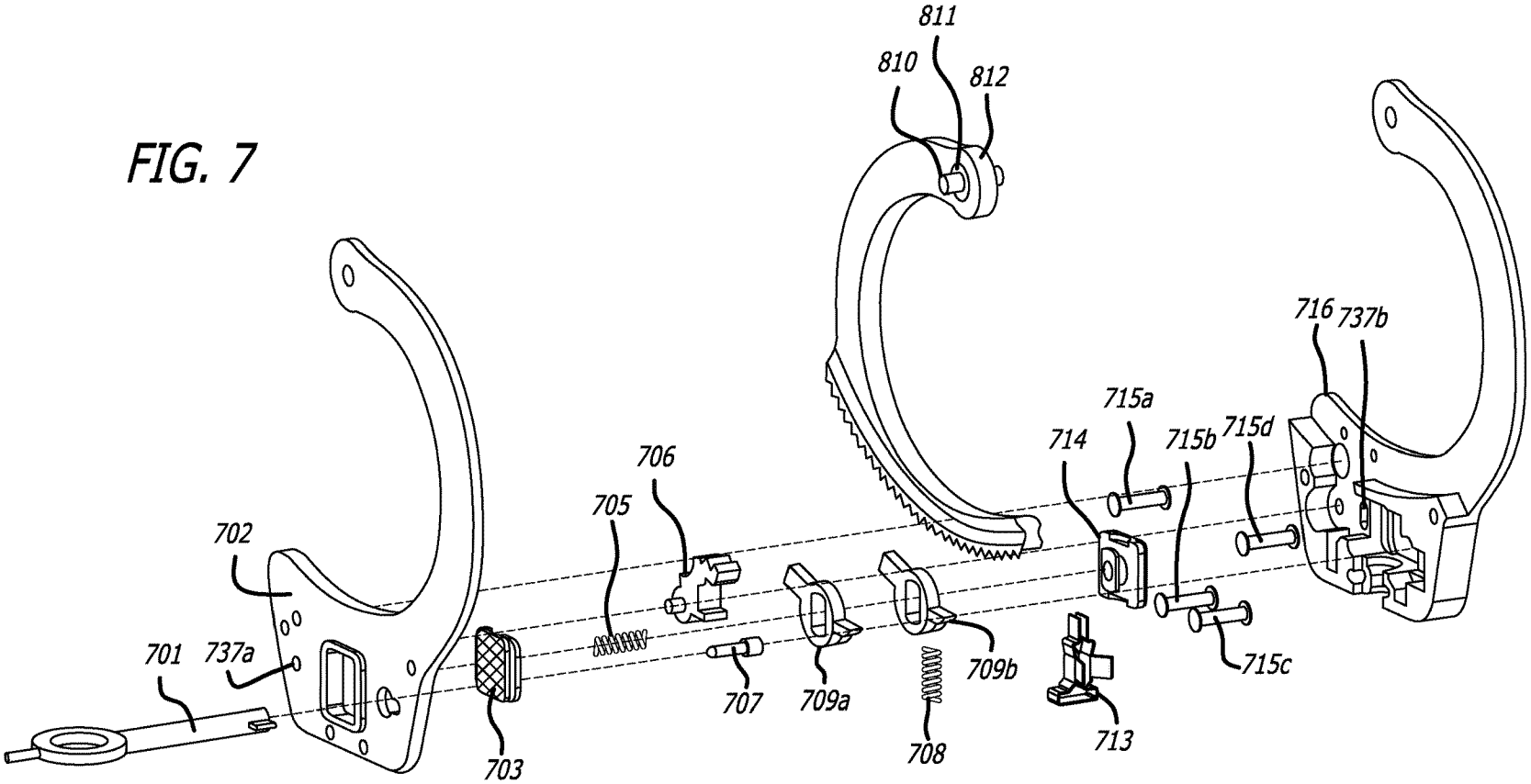
FIG. 7 shows an exploded view of an alternate version of the design with a two part rocker or rocker element and no star wheel employed.

FIG. 7 illustrates an alternate version of the device, including top double strand 702, top button 703, key guide 707, bottom button 714, button spring 705, key action spring 713, binding pawl 706, single strand 712, clasp pivot rivet 710, binding pawl spring 708, two rocker elements in this embodiment, top half rocker element 709*a* and bottom half rocker element 709*b*, and bottom double strand 706. In this view, no anti-shim star wheel is employed, and such a device may be considered optional. Further, this view illustrates top double lock hole 737*a* and bottom double lock hole 737*b*. Also shown is key 701, clasp pivot bushing 711, and four double strand rivets 715*a*, 715*b*, 715*c*, and 715*d* offer support between top double strand 701 and bottom double strand 716.

Figure 8:
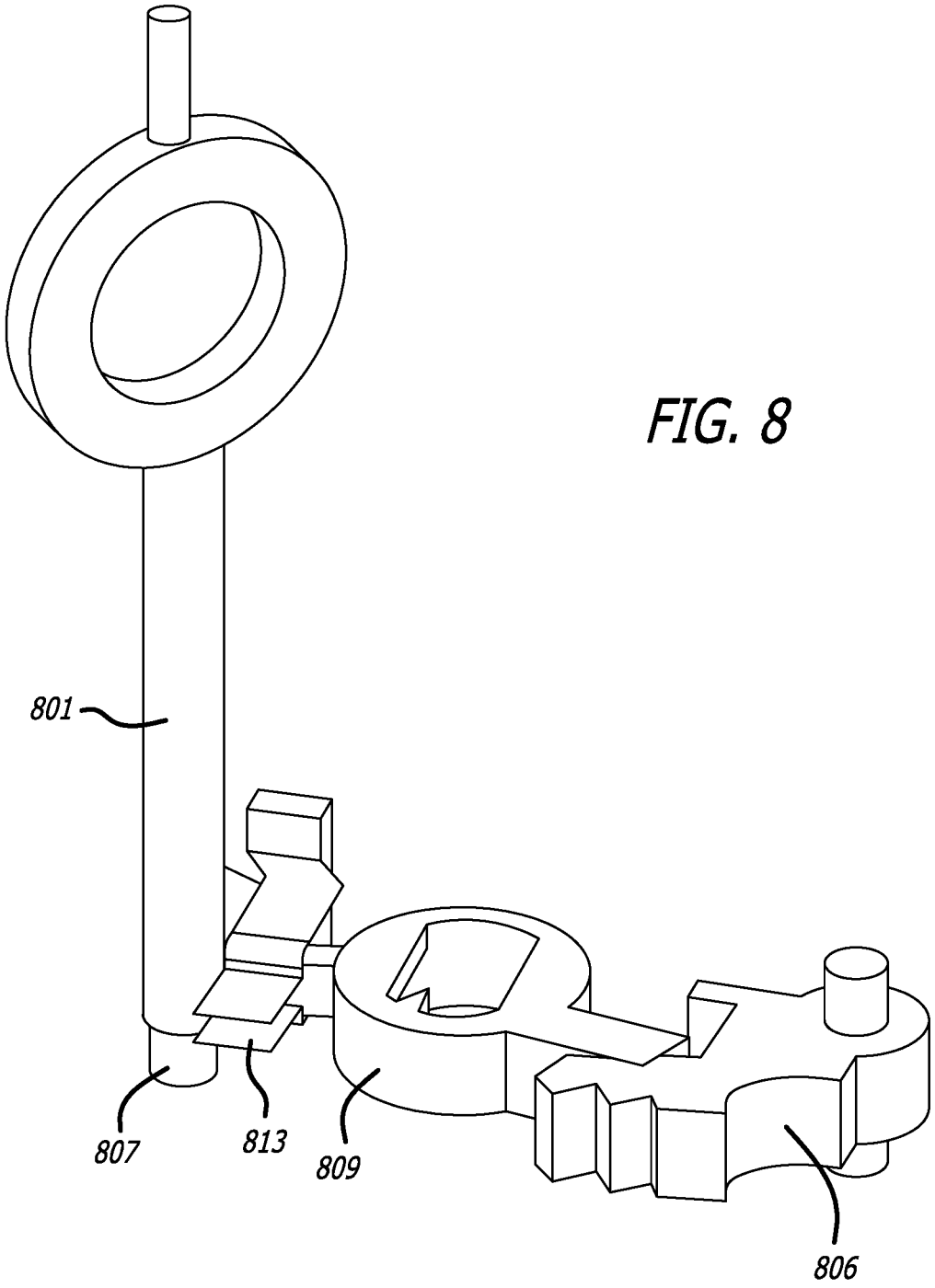
FIG. 8 shows operation of the key with the internal components of the design.

FIG. 8 is presented to generally show key operation in conjunction with the top button, back button, and rocker arrangement. From FIG. 8, key 801 is positioned on key guide 807 and causes movement of key action spring 813 and rocker 809, causing rotation of binding pawl 806.

FIGS. 9A, 9B, 9C, and 9D show cross sectional and/or perspective representations of the top button, bottom button, and rocker 909A, 909B, 909C, 909D, and 909E, wherein FIGS. 9A and 9B are two dimensional side view representations. Top button 903 and bottom button 904 are shown in these views in various configurations, as is rocker element 909A, 909B, 909C, and 909D. Views presented include, in FIG. 9A, a view of the device with both buttons disengaged or not pressed, in FIG. 9B a two dimensional view with both buttons engaged or pressed, FIG. 9C a perspective view, FIG. 9D a cutaway perspective view with the buttons 903 and 904 engaged, and FIG. 9E a perspective view with the buttons 903 and 904 disengaged.

Figure 10:
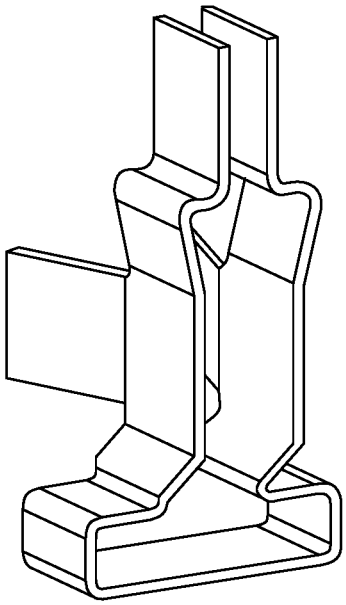
FIG. 10 illustrates an embodiment of the double lock spring employed.
Figure 11A:
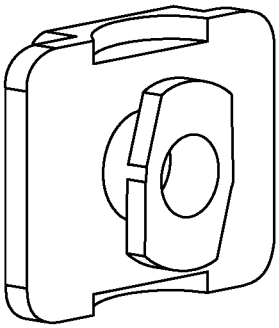
FIG. 11A includes a perspective view of the top button.
Figure 11B:
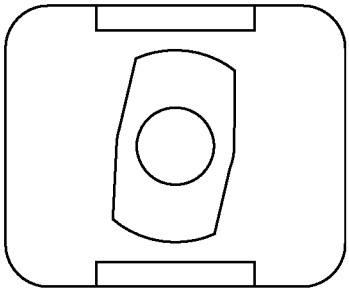
FIG. 11B is a plan view of the rear or back of the top button.
Figure 11C:
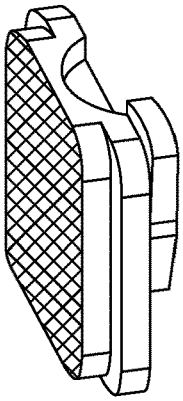
FIG. 11C shows a perspective view of the bottom button.
Figure 11D:
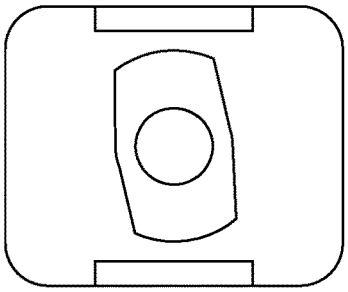
FIG. 11D is a plan view of the rear or back of the bottom button.
Figure 12:
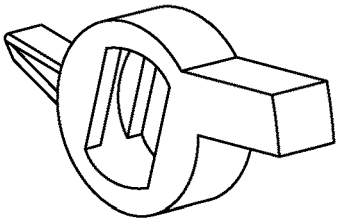
FIG. 12 shows the unique rocker element employed in one embodiment of the design.

FIG. 10 illustrates a perspective view of one embodiment of the key action spring or double lock spring employed. FIG. 11A includes a perspective representation of the top button, while FIG. 11B shows a plan view of the back side of the top button. FIG. 11C is a perspective view showing the bottom button in one embodiment, while FIG. 11D illustrates a plan view of the back side of the bottom button. FIG. 12 illustrates the unique rocker element employed in one embodiment of the design.

FIGS. 13A through 13F illustrate a series of single cuffs with components as described herein being operated and the various positions, rotations, and orientations of the components of import employed in the present design. Note that the buttons, while discussed, are not shown in any of FIGS. 13A through 13F. Different configurations of the buttons are discussed herein and are of course necessary to effectuate the functionality provided. FIGS. 13A through 13F are shown to illustrate the inner workings and inner components of the design during operation.

Figure 13A:
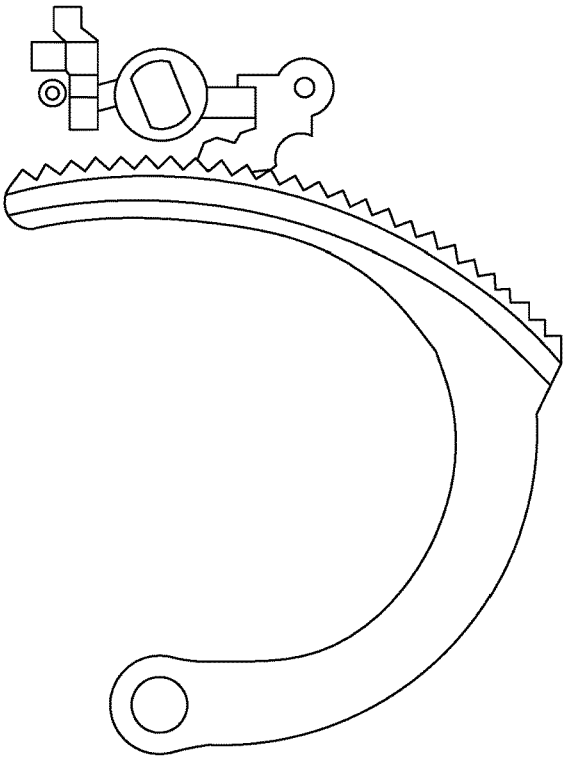
FIGS. 13A through 13F illustrate a series of single cuffs with components as described herein being operated and the various positions, rotations, and orientations of the components of import employed in the present design.
Figure 13B:
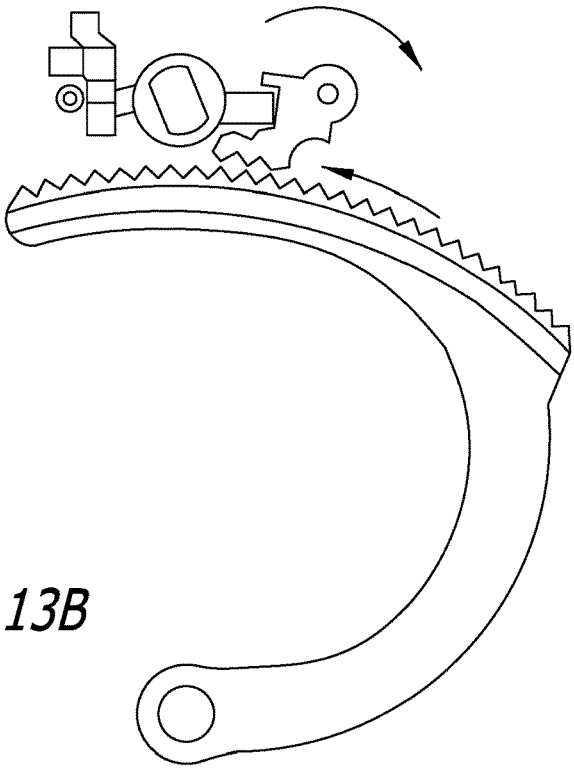
Figure 13C:
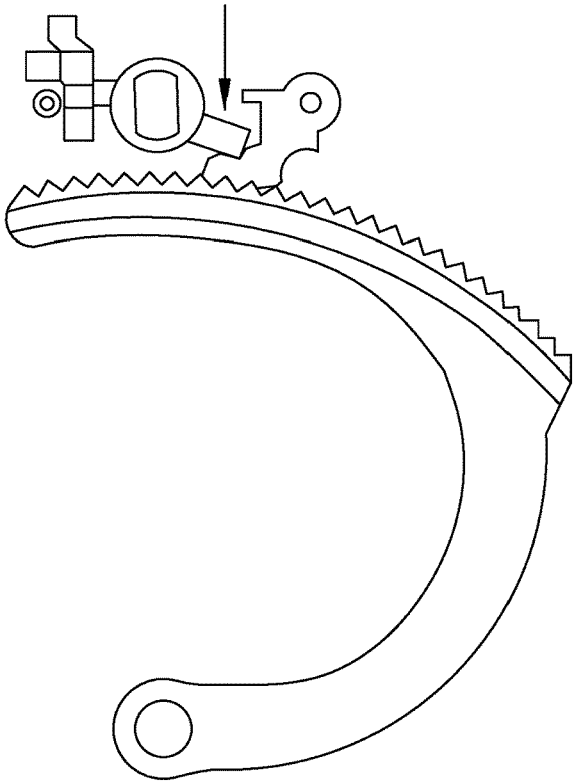
Figure 13D:
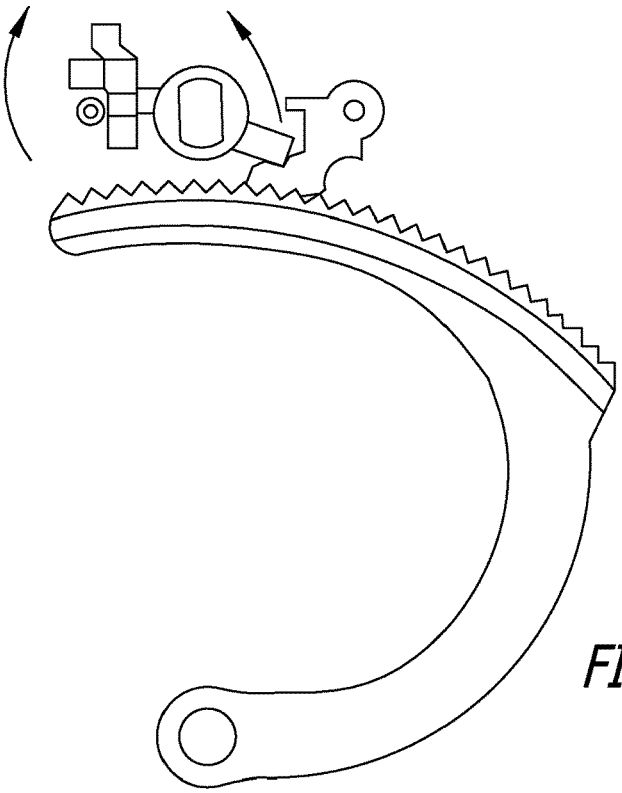
Figure 13E:
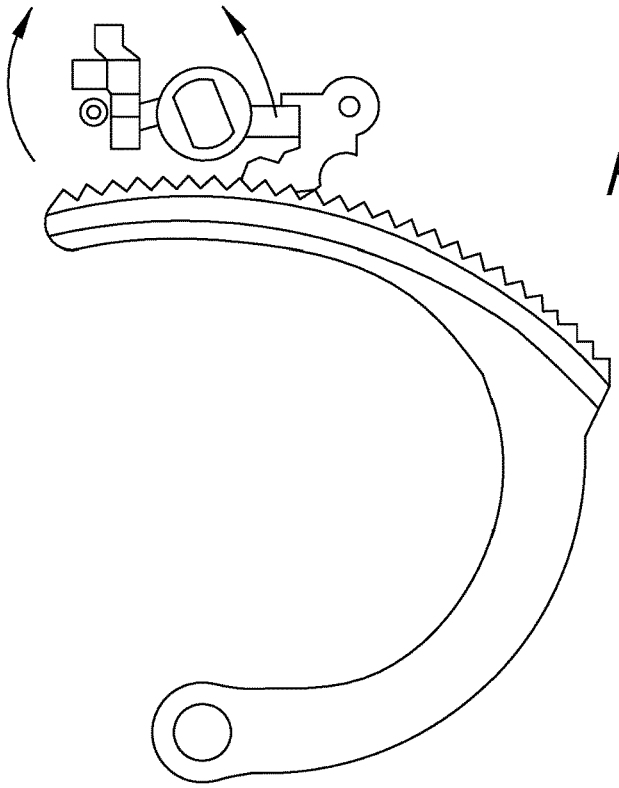
Figure 13F:
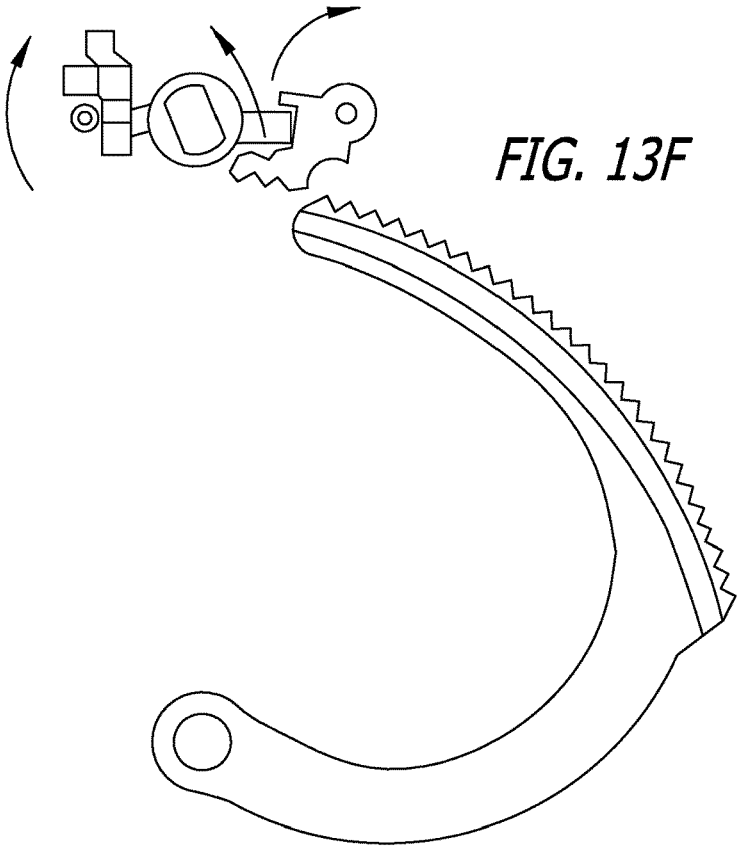

FIG. 13A illustrates the cuff in a ready state, where the double lock spring is spread, and the buttons (not shown) are depressed. FIG. 13B shows speed cuffing, where the double lock spring is spread and the buttons (not shown) are depressed, so the single strand can be rapidly tightened about an individual. The binding pawl is not locked and simply rotates as shown such that the single strand can readily rotate in a counterclockwise direction in the orientation shown. FIG. 13C shows a double lock arrangement where the double lock spring is not spread and retains or holds the rocker arm in a single position. The buttons (not shown) in this configuration may be forced outward. FIG. 13D is a release configuration where the buttons (not shown) are depressed, the key is inserted and turned, and the double lock spring is spread. In this configuration, the spring moves down, rotating the rocker counterclockwise, but in this orientation not contacting the binding pawl such as to cause rotation of the binding pawl. FIG. 13E shows the key being inserted and the rocker contacting the binding pawl, where the double lock spring is spread and the buttons (not shown) remain depressed. FIG. 13F illustrates the key inserted and rotating of the binding pawl to release the single strand, where the double lock spring is spread in this orientation and teeth of the binding pawl are completely disengaged from the single strand. In these views, and in particular FIGS. 13D, 13E, and 13F, the key engages a key guide and rotates in a manner causing rotation of the rocker element.

Figure 14:
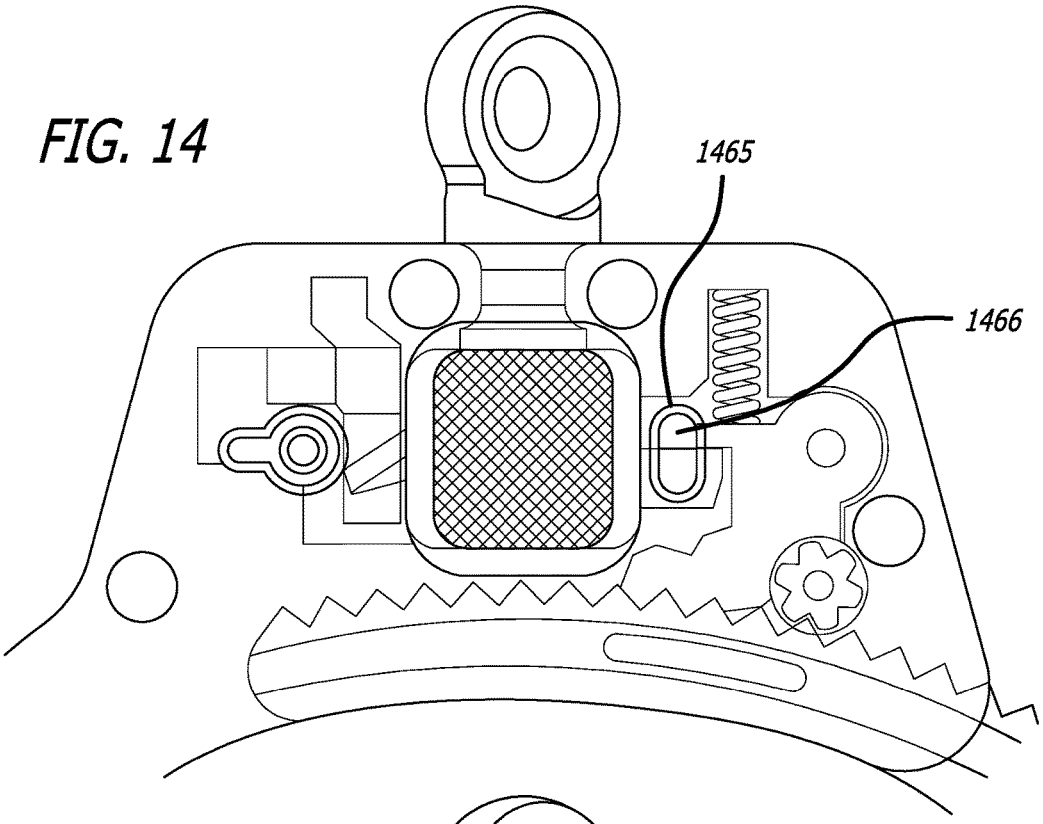
FIG. 14 illustrates a design aspect of the present design that could potentially be exploited.
Figure 15:
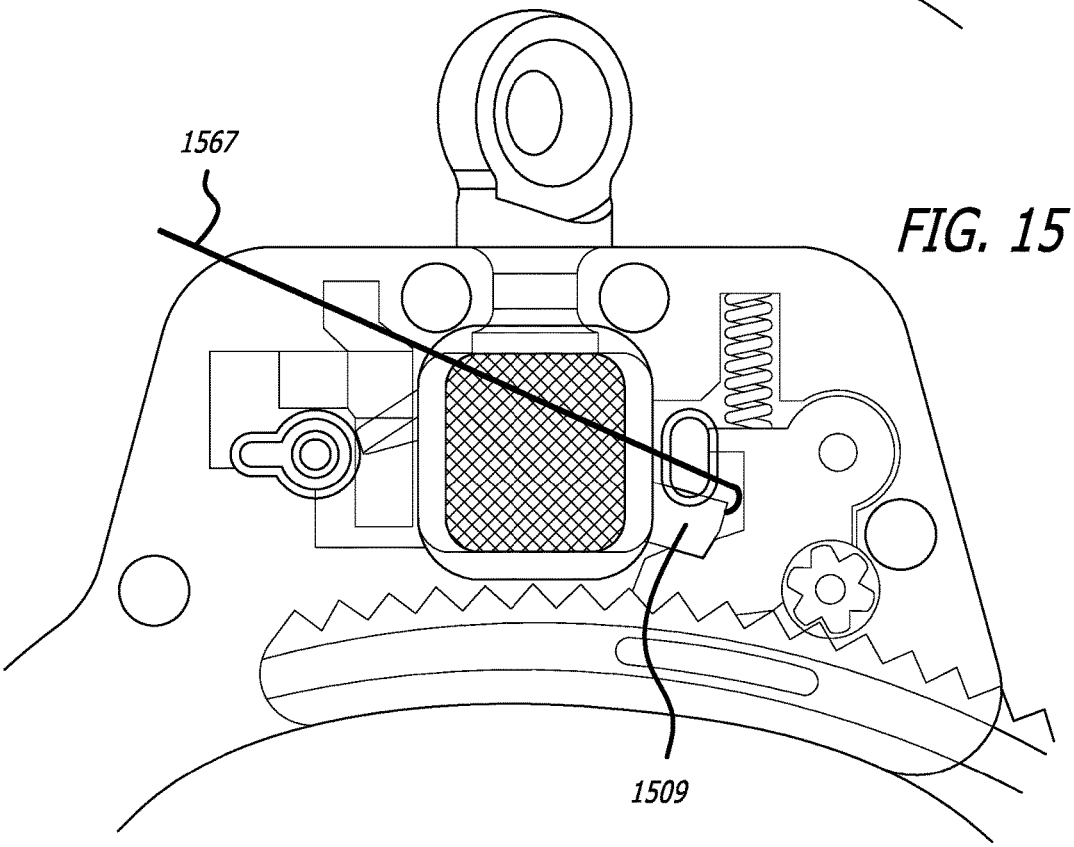
FIG. 15 shows another potential risk associated with a handcuff design.

FIG. 14 shows a representation of a potential issue with a design similar to that presented above. From FIG. 14, area 1465 surrounds the "double lock hole" 1466. These areas are open and can be accessed via an inserted lock pick. One method to defeat this system is use of a hook shaped lock pick, inserted in the hole and pulled against the back of the pawl. One representation of picking in this manner is presented in FIG. 15, with rocker 1509 reached by hook shaped lock pick 1567 and lifted or pried upward. Other types of lock picks may be employed, such as an L-shaped pick, shown in FIG. 16. From FIG. 16, L-shaped pick 1668 may be employed through area or opening 1665 to pry binding pawl 1606 upward or in a clockwise rotational manner. Alternately, some type of pick or shim may be employed to push binding pawl spring 1608 upward, loosening the spring's contact with binding pawl 1606 and thus the binding pawl's contact with the single strand.

Figure 18:
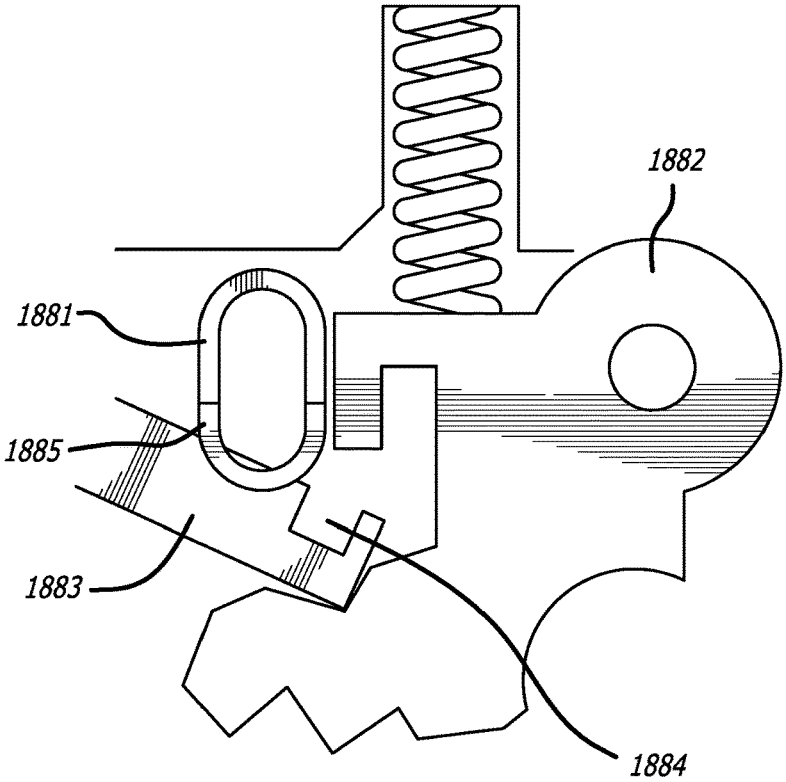
FIG. 18 is a second view of the first alternate design.
Figure 19A:
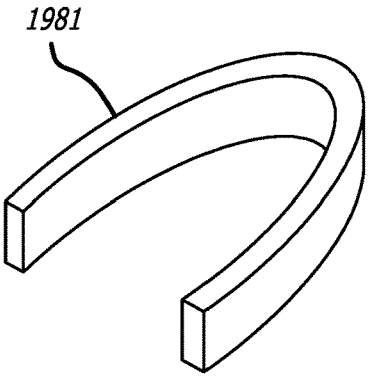
FIG. 19A presents the U-shaped wall employable with the alternate design.

Certain solutions are presented in FIGS. 17 through 19. From FIG. 17, an internal metal wall 1781, into the paper in this orientation, is provided around the double lock hole. The internal metal wall 1781 is U-shaped and shown in further detail in FIG. 19A, and does not extend at the lower part of the keyhole 1785 in this configuration. This internal metal wall prevents insertion of a tool or shim or pin to attack the binding pawl 1782 or spring. Note the different interlocking shapes of alternate binding pawl 1782 and the outer arm of alternate rocker 1783, with a notch provided in the rocker and a corresponding prong in alternate binding pawl 1782.

Figure 19B:
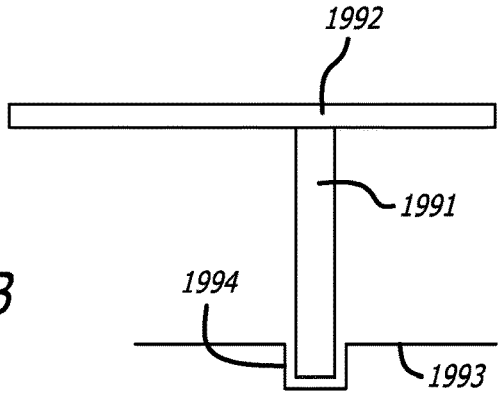
FIG. 19B illustrates the U-shaped wall in one embodiment joined with the top and bottom double strands of the present design.

FIG. 18 shows the alternate design with partial rotation of alternate rocker arm 1883 such that the notch provided therein is disengaging from a notch provided on alternate binding pawl 1882. In this view, the notch 1884 in the rocker arm still engages with the pawl to prevent a hook or L-shaped shim or pin from pulling up on the alternate binding pawl 1882. Top 1881 of the U-shaped metal wall is also called out in FIG. 18, as well as bottom 1885 of the U-shaped wall. FIG. 19A shows the U-shaped wall 1981 used with the double lock hole shown in FIG. 17. This wall can be produced as a portion of the top double strand or the bottom double strand. FIG. 19B shows the wall 1991 which in this orientation is formed with or joined to top double strand 1992 and mates with the bottom double strand 1993 using a tongue-in-groove joint 1994, increasing the strength against lock picking maneuvers.

This alternate design reflected in FIGS. 17 through 19B is an optional design that can be used to decrease risk of picking using foreign objects, but is not necessary. Such a design as reflected in the preceding drawings may be employed alone and/or with aspects shown in FIGS. 17 through 19B. For example, simply using the U-shaped wall, such as U-shaped wall 1981, may serve to defeat many shim situations. Other portions of the alternative design may be employed.

Other versions of the various components may be offered, such as a rocker having a different construction, or a double lock spring that appears differently but performs the same function. However, the teachings of the present design, including two facing buttons, an arrangement to enable turning of a key in combination with button pressing to release the cuff, and in certain instances a star wheel component, may be employed to obtain the benefits discussed herein.

Further, while a single cuff is shown in the present drawings, it is understood that such cuffs are typically provided in pairs, and a pair of handcuffs according to the present design may include two handcuffs joined by a chain in accordance with the present disclosure or one such handcuff and a more traditional handcuff joined by a chain.

Thus according to the present design, there are provided buttons that must be depressed simultaneously with the turning of a universal key. The design also includes a rocker arm, in one embodiment having a circular type central component with two peripheral "arms" specially formed therewith. The rocker arm rotationally engages and disengages with the aforementioned buttons. Engagement and disengagement is the consequence of spring loading the buttons in one direction and depressing them in the opposite direction by a user's fingers. This combined action results in the engagement and disengagement of mating flat features on the buttons, stopping or enabling and facilitating rotation of the rocker arm. This depends on whether the buttons are in a closed/locked orientation (extended by the spring) or an open/unlocked orientation (depressed by the user).

The design decreases or eliminates the use of a traditional double lock bar, thus reducing or eliminating the risk associated with an inertia striking action that can disengage a double lock bar. Previous designs have used a spring-loaded pawl to engage mating ratchet teeth to a pivoting strand's ratchet teeth. Should these mating teeth wear over time, it is possible that the cuff or cuffs can be rendered inoperable. The present design employs a pawl that exerts a pivoting force that increases as the strand is pulled upon in the direction of release. This action is the result of the approximate location of the pivot of the binding pawl relative to the pivot location and rotational direction of the single strand.

The present design also utilizes an anti-pick spring device that retains the rocker arm in position and prevents picking from the keyhole when the handcuff is in a locked or double locked orientation. The spring, called a double lock spring, is a "U" shaped spring with angled lead in tangs that allow a universal handcuff key to spread the "U" shape of the spring. At the ends of each leg of the "U" are corresponding "L" shaped catching features that engage the end of the rocker arm, preventing the rocker arm from rotating into an unlocked position. As the user turns the universal handcuff key clockwise, the angled lead in tangs spread, releasing the "L" shaped catches, thus allowing the rocker arm to rotate. This consequently engages the opposite end of the rocker arm to the binding pawl and releases the single strand. The action of spreading the anti-pick spring in both an upward and downward direction and simultaneously slot formed in the rotate the rocker arm while using a picking device makes it difficult or impossible to pick the lock from the keyhole.

Figure 20:
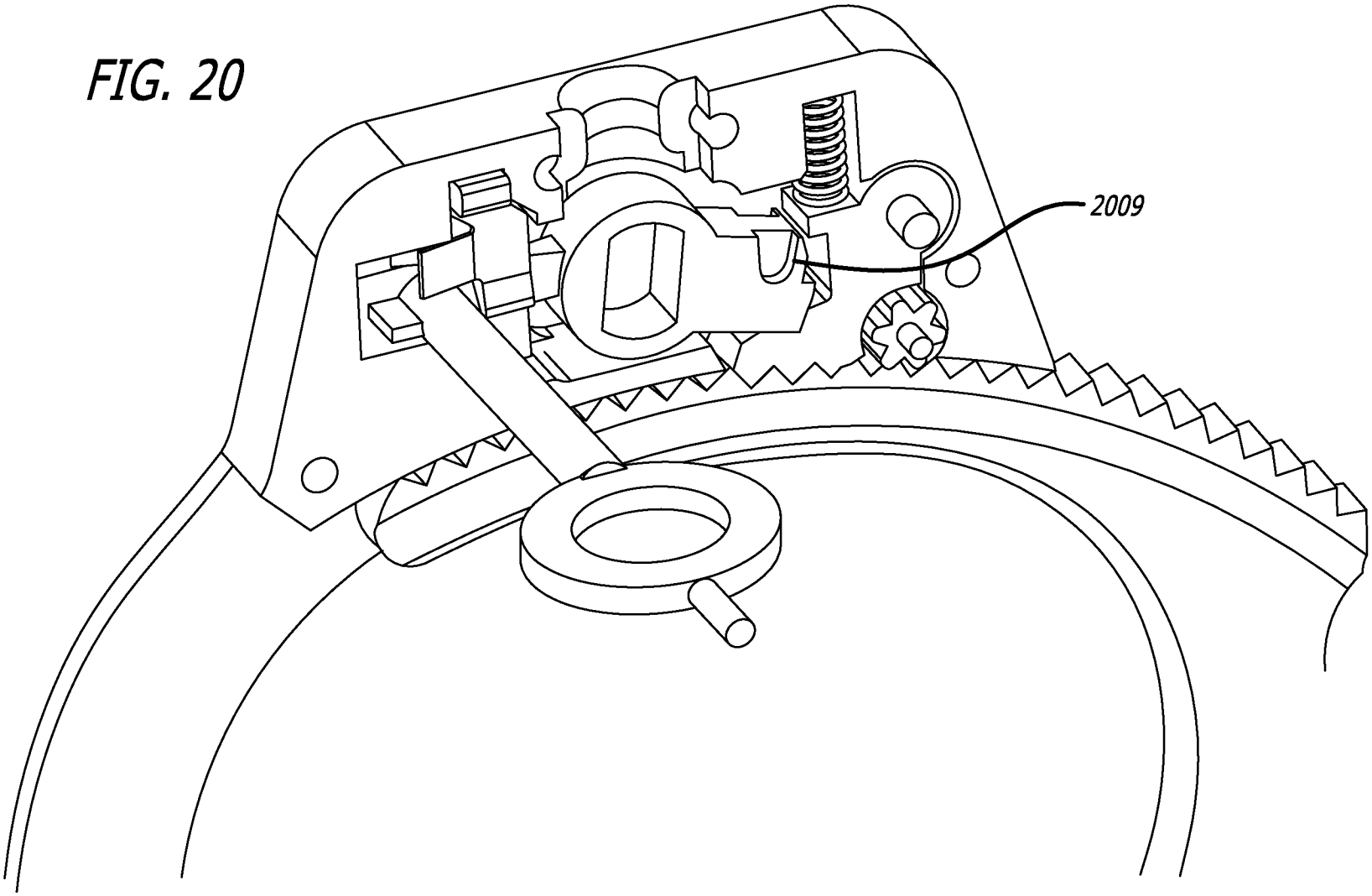
FIG. 20 is an alternate design of the enhanced handcuffs with a revised rocker or rocker element.

As a further alternative, the present design may employ other countermeasures inhibiting picking or defeating. FIG. 20 illustrates one representation of an alternate countermeasure design. In this version, a groove or slot is formed in the rocker or rocker element 109, shown as element 2009 in FIG. 20, typically having a slight indentation depth, for example one millimeter or more. The groove or slot may have a shape similar or identical to the opening, such as hole or keyhole 1785, with the rocker or rocker element 2009 being thickened vertically, on the right side of the rocker or rocker element. Such a vertically thickened rocker or rocker element prevents shim access through the hole provided.

To be clear, use of the "user" in this document is intended broadly and can mean the wearer or the person releasing the cuff from the wearer. In some instances, one individual, including the wearer, may have his or her hand on one or both buttons while a second individual is turning a key in the cuff to release the cuff. Hence any recitation of "user" "wearer" "suspect" "person" "individual" or other entity operating the current design is not intended to be limiting.

The present design also employs a star wheel shaped piece in one embodiment that rotates on shafts inserted into holes of the double strand pieces of the handcuff. The star wheel's teeth mesh with the ratchet teeth of the single strand. The meshing of these two mating teeth prevent a pick from passing through, in between them. Such a device is optional and may or may not be included in an individual cuff in accordance with the present design.

The rocker arm includes an extended bar feature. At the end opposite where the key engages the rocker arm is an extended bar feature that engages the binding pawl. This extended arm serves two purposes—first, to unlock the handcuff by engaging with the binding pawl. Unlocking is the result of the universal handcuff key being turned clockwise when inserted into the keyhole. This action rotates the rocker arm in a counterclockwise direction such that the extended bar feature engages a protrusion of the binding pawl, rotating the binding pawl in a direction that disengages its ratcheting teeth from the ratcheting teeth of the single strand provided. A second purpose of the extended bar of the rocker arm is used to double lock the handcuff after the handcuff has been attached to a suspect's wrist. The universal key has a protrusion located on its handle end. This protrusion is used for double locking. The key is inserted into a slot located on each face of the double strand cuff assembly. After insertion the key is pushed in the direction of the wrist, rotating the rocker arm clockwise. The extended bar feature of the rocker arm then rotates into a notch of the binding pawl, preventing the binding pawl from rotating. This engagement also serves to keep the single strand from ratcheting further against the wrist that, in the past, has caused injury to the wrist.

Thus according to one embodiment, there is provided a handcuff comprising a handcuff strand comprising ratchet teeth, a pair of buttons on opposing sides of the handcuff, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when both of the pair of buttons are depressed.

According to a second embodiment, there is provided a handcuff comprising a handcuff strand comprising ratchet teeth, a pair of buttons, each button of the pair of buttons positioned within a respective opposite facing exterior strand of the handcuff, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when both of the pair of buttons are depressed.

According to a third embodiment of the present design, there is provided a handcuff comprising a handcuff strand comprising ratchet teeth, a first button positioned within a first double strand element, the first button positioned proximate to and opposite a second button positioned within a second double strand element, and a spring configured to receive rotational force from a key and cause rotation of a first rotating element. Rotation of the first rotating element rotates a second rotating element, releasing the second rotating element from the ratchet teeth of the handcuff strand and allowing release of the handcuff strand when the first button and the second button are depressed.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. A handcuff comprising:

a handcuff strand comprising ratchet teeth;

a pair of buttons on opposing sides of the handcuff, the pair of buttons connected by a button joining element; and a spring configured to receive rotational force from a key and cause rotation of a first rotating element;

wherein the first rotating element rotates about the button joining element, and rotation of the first rotating element about the button joining element rotates a second rotating element, releasing the second rotating element from the ratchet teeth of the handcuff strand and allowing release of the handcuff strand when both of the pair of buttons are depressed.

2. The handcuff of claim 1, wherein the button joining element comprises a further spring.

3. The handcuff of claim 2, wherein the further spring passes through an opening in the first rotating element.

4. The handcuff of claim 1, further comprising a star wheel configured to engage the ratchet teeth of the handcuff strand and inhibit a foreign object from contacting the second rotating element.

5. The handcuff of claim 1, further comprising a key action spring configured to maintain the second rotating element in a position inhibiting movement of the ratchet teeth of the handcuff strand.

6. The handcuff of claim 1, further comprising a top double strand through which the key passes and configured to receive a first button of the pair of buttons.

7. The handcuff of claim 6, further comprising a bottom double strand configured to receive a second button of the pair of buttons.

8. The handcuff of claim 7, further comprising a star wheel element configured to join the top double strand and the bottom double strand, engage the ratchet teeth of the handcuff strand, and inhibit a foreign object from contacting the second rotating element.

9. A handcuff comprising:

a handcuff strand comprising ratchet teeth;

a pair of buttons connected by a button joining element, each button of the pair of buttons positioned within a respective opposite facing exterior strand of the handcuff; and a spring configured to receive rotational force from a key and cause rotation of a first rotating element;

wherein the first rotating element rotates about the button joining element, and rotation of the first rotating element about the button joining element rotates a second rotating element, releasing the second rotating element from the ratchet teeth of the handcuff strand and allowing release of the handcuff strand when both of the pair of buttons are depressed.

10. The handcuff of claim 9, wherein the button joining element comprises a further spring.

11. The handcuff of claim 10, wherein the further spring passes through an opening in the first rotating element.

12. The handcuff of claim 9, further comprising a star wheel configured to engage the ratchet teeth of the handcuff strand and inhibit a foreign object from contacting the second rotating element.

13. The handcuff of claim 9, further comprising a key action spring configured to maintain the second rotating element in a position inhibiting movement of the ratchet teeth of the handcuff strand.

14. The handcuff of claim 9, further comprising a star wheel element configured to join the top double strand and the bottom double strand, engage the ratchet teeth of the handcuff strand, and inhibit a foreign object from contacting the second rotating element.

15. A handcuff comprising:

a handcuff strand comprising ratchet teeth;

a first button positioned within a first double strand element, the first button positioned proximate to and opposite a second button positioned within a second double strand element;

a button joining element located between the first button and the second button; and a spring configured to receive rotational force from a key and cause rotation of a first rotating element;

wherein the first rotating element rotates about the button joining element, and rotation of the first rotating element about the button joining element rotates a second rotating element, releasing the second rotating element from the ratchet teeth of the handcuff strand and allowing release of the handcuff strand when the first button and the second button are depressed.

16. The handcuff of claim 15, wherein the button joining element comprises a further spring.

17. The handcuff of claim 16, wherein the further spring passes through an opening in the first rotating element.

18. The handcuff of claim 15, further comprising a star wheel configured to engage the ratchet teeth of the handcuff strand and inhibit a foreign object from contacting the second rotating element.

19. The handcuff of claim 15, further comprising a key action spring configured to maintain the second rotating element in a position inhibiting movement of the ratchet teeth of the handcuff strand.

20. The handcuff of claim 15, further comprising a star wheel element configured to join the first double strand element and the second double strand element, engage the ratchet teeth of the handcuff strand, and inhibit a foreign object from contacting the second rotating element.

* * * * *